US008616384B1

(12) United States Patent
Tucker

(10) Patent No.: US 8,616,384 B1
(45) Date of Patent: Dec. 31, 2013

(54) BAG CLIP STRIP

(76) Inventor: Christopher D. Tucker, Oklahoma City, OK (US)

( * ) Notice: Subject to any disclaimer, the term of this patent is extended or adjusted under 35 U.S.C. 154(b) by 0 days.

(21) Appl. No.: 13/385,507

(22) Filed: Feb. 23, 2012

(51) Int. Cl.
*A47G 29/00* (2006.01)

(52) U.S. Cl.
USPC ..... 211/85.15; 211/97; 248/288.31

(58) Field of Classification Search
USPC ..... 211/85.15, 85.26, 116, 118, 19, 49.1, 211/95–97; 248/95, 101, 288.31, 288.51; 403/56, 76, 90, 122
See application file for complete search history.

(56) References Cited

U.S. PATENT DOCUMENTS

| | | | | | |
|---|---|---|---|---|---|
| 381,265 | A | | 4/1888 | Martens | |
| 2,532,020 | A | | 11/1950 | Gunderson | |
| 3,195,733 | A | * | 7/1965 | Best | 211/45 |
| 4,067,532 | A | * | 1/1978 | Viteretto | 248/683 |
| 4,070,011 | A | * | 1/1978 | Glesser | 269/45 |
| 4,108,315 | A | * | 8/1978 | Inao | 211/124 |
| 4,461,387 | A | | 7/1984 | Belokin, Jr. | |
| 4,501,358 | A | * | 2/1985 | Zinbarg | 206/371 |
| 4,767,012 | A | | 8/1988 | Simmons | |
| 4,980,805 | A | * | 12/1990 | Maglica et al. | 362/191 |
| 5,106,177 | A | * | 4/1992 | Dolasia | 359/876 |
| 5,112,071 | A | * | 5/1992 | Jones | 280/152.3 |
| 5,128,841 | A | * | 7/1992 | Maglica et al. | 362/191 |
| 5,339,967 | A | | 8/1994 | Valiulis | |
| D367,574 | S | | 3/1996 | Werner | |
| 5,515,978 | A | * | 5/1996 | Moran | 211/30 |
| 5,603,417 | A | * | 2/1997 | Blair | 211/85.15 |
| 5,775,654 | A | * | 7/1998 | Price | 248/231.61 |
| 5,967,341 | A | | 10/1999 | Werner | |
| 6,105,217 | A | | 8/2000 | Caradine | |
| D440,148 | S | | 4/2001 | Kan | |
| 6,213,316 | B1 | | 4/2001 | Gretz | |
| 6,363,588 | B1 | | 4/2002 | Caradine | |
| D485,106 | S | * | 1/2004 | Dion | D6/553 |
| 6,813,814 | B1 | | 11/2004 | Schultz | |
| 2007/0253765 | A1 | * | 11/2007 | Knopp et al. | 403/122 |
| 2008/0061195 | A1 | * | 3/2008 | Carnevali | 248/125.8 |
| 2008/0142652 | A1 | * | 6/2008 | Johnson | 248/176.1 |
| 2012/0132764 | A1 | * | 5/2012 | Ball et al. | 248/125.1 |

* cited by examiner

*Primary Examiner* — Korie H Chan
(74) *Attorney, Agent, or Firm* — Randal D. Homburg

(57) ABSTRACT

A rigid strip attached to a vertical surface provides a plurality of ball socket clips which independently hold a balled end of a bag clip to independently retain each bag clip upon the common surface of the strip, the strip being attachable to a vertical surface in a location desired to store a plurality of bags, with each clip being maintained on each attached bag due to each balled end being withdrawn from each respective ball socket clip without disruption of the clip from the retained bag.

4 Claims, 4 Drawing Sheets

BAG CLIP STRIP

CROSS REFERENCE TO RELATED APPLICATIONS

None.

I. BACKGROUND OF THE INVENTION

1. Field of Invention

A rigid strip attached to a vertical surface provides a plurality of ball socket clips which independently hold a balled end of a bag clip to independently retain each bag clip upon the common surface of the strip, the strip being attachable to a vertical surface in a location desired to store a plurality of bags, with each clip being maintained on each attached bag due to each balled end being withdrawn from each respective ball socket clip without disruption of the clip from the retained bag.

2. Description of Prior Art

A preliminary review of prior art patents was conducted by the applicant which reveal prior art patents in a similar field or having similar use. However, the prior art inventions do not disclose the same or similar elements as the present bag clip strip, nor do they present the material components in a manner contemplated or anticipated in the prior art.

Clips which are used to close a bag of objects are disclosed in U.S. Pat. No. 6,105,217 to Caradine, which provides a spring clip which attaches to the edge of a bag. Likewise, U.S. Pat. No. 6,363,588, also to Carradine, discloses a bag clip with an elongated margin attaching to the bag, further having a spring to urge the aligned edges together for a bag closure. These bag clips are also shown in U.S. Pat. No. 6,813,814 to Shultz and D440148 to Kan. An earlier bag fastener is disclosed in U.S. Pat. No. 381,265 to Martens.

Strips which are used to retain a plurality of bags for display purposes are also disclosed in several prior art patents. These include U.S. Pat. No. 2,532,020 to Gunderson which provides a vertical strip with a plurality of fixed clips for suspending bags, a vertical display stand for hanging several bags or articles shown in U.S. Pat. No. 4,461,387 to Belokin, Jr., a strip hanger disclosed in U.S. Pat. No. 4,767,012 to Simmons, and U.S. Pat. No. 5,339,967 to Valiulis, attaching to a shelf, which suspends several display items. A plurality of permanently attached spring clips are shown in U.S. Pat. No. 5,967,341 to Werner provides the strip hanging over an edge. U.S. Pat. No. 6,213,316 to Gretz has an integrally molded strip with a plurality of clips to suspend several heavy produce items. A flat strip provides several independent attached spring clips in D485106 to Dion, while a plurality of upward oriented clips are shown in U.S. Pat. No. D367574 to Werner.

None of these prior art strips provide a removable independent clip which can be removed from a strip and maintain closure of a bag which can be suspended from the strip attached to a vertical surface.

II. SUMMARY OF THE INVENTION

Storage of food bags is a problem in many households. Bags of food will become spoiled, dry and stale if the bag is not maintained between uses, and bag clips are commonly used to keep them closed. These bags are usually simply stacked on shelves or kept in baskets for storage. It would be handy and useful to provide a means of keeping the closed bags in an area that would be both compact and convenient during storage, with the bags being held in a position to see the contents of the bags. Thus, keeping the bags suspended upon a vertical strip would meet this convenient storage objective.

A strip is provided with a plurality of attaching points along a vertical axis with the clips being attached to each bag and independently held or removed without disruption to the remaining bags, with the bag being removed with the clip to maintain closure of the bags until use, with the clip remaining with each bag to be further reattached to the bag and then replaced along the vertical strip.

III. DESCRIPTION OF THE DRAWINGS

The following drawings are submitted with this utility patent application.

IV. DESCRIPTION OF THE PREFERRED EMBODIMENT

Figure 1:
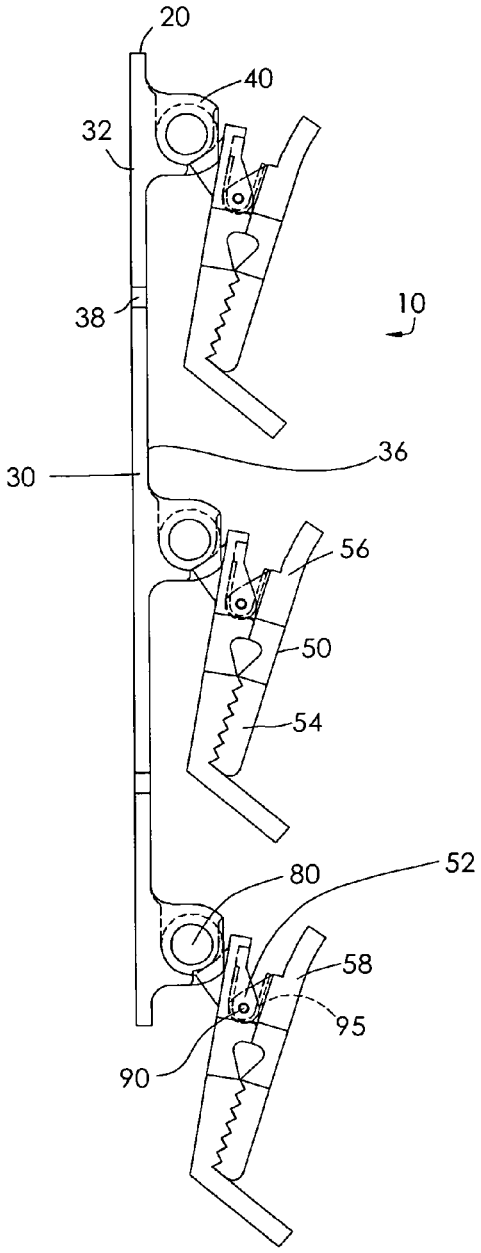
FIG. 1 is a side view of the clip strip attaching a plurality of bag clips.

A bag clip strip 10, shown in FIGS. 1-11, provides a storage means for retaining a plurality of open bags containing a product, the bag clip strip 10 comprising a clip strip 20 defining a flat planar mounting body 30 upon which a plurality of resilient ball clip attaching sockets 40 are provided, each ball clip attaching socket 40 defining a spherical void 41 and a plurality of bag clips 50, each bag clip 50 defining a spring clip 52 having a lower end 54 attachable to a bag, an upper end 56 defining a compression flange 58 which is depressed to urge the lower end 54 into an open position, and a rear spherical projection 80 which is independently inserted within and retained by one of the plurality of attaching sockets 40, the plurality of attaching sockets 40 each capable of independently retaining a single bag clip 50.

Figure 2:
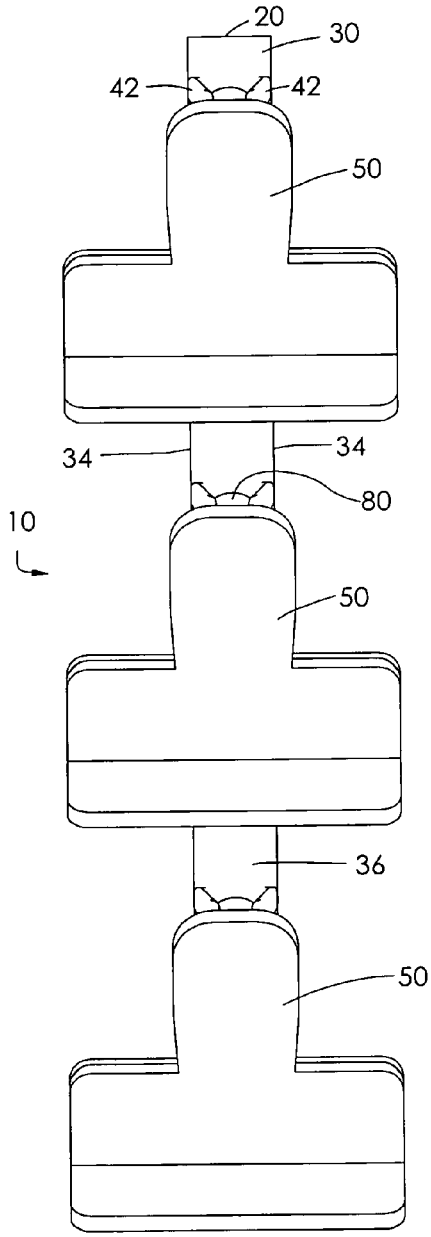
FIG. 2 is a front view of the clip strip attaching a plurality of bag clips, as shown in FIG. 1
Figure 3:
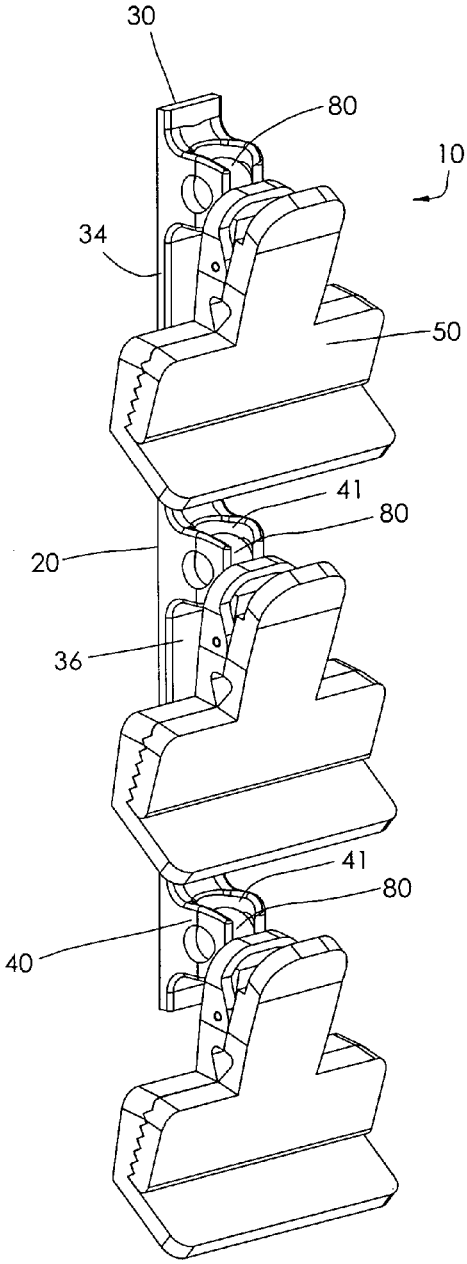
FIG. 3 is a perspective view of the clip strip and plurality of bag clips.
Figure 6:
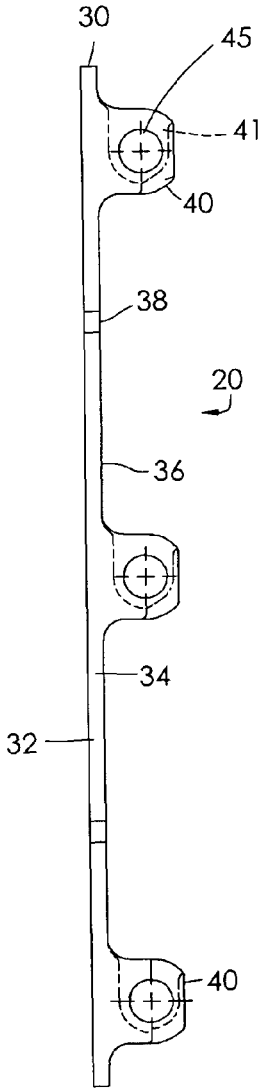
FIG. 6 is a side view of the clip strip.
Figure 7:
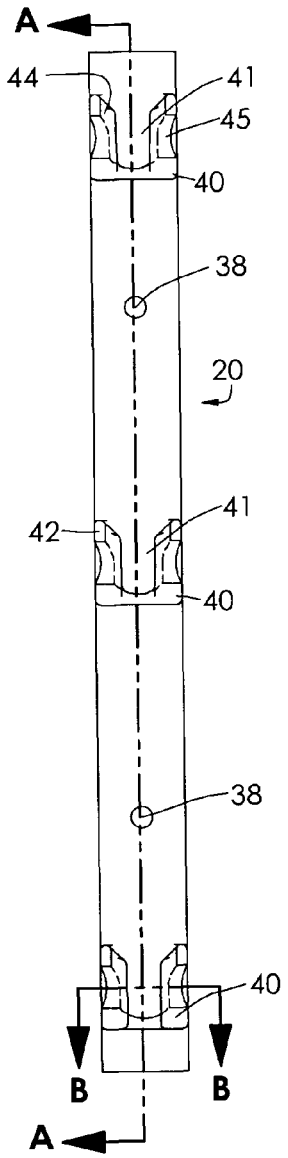
FIG. 7 is a front view of the clip strip.
Figure 8:
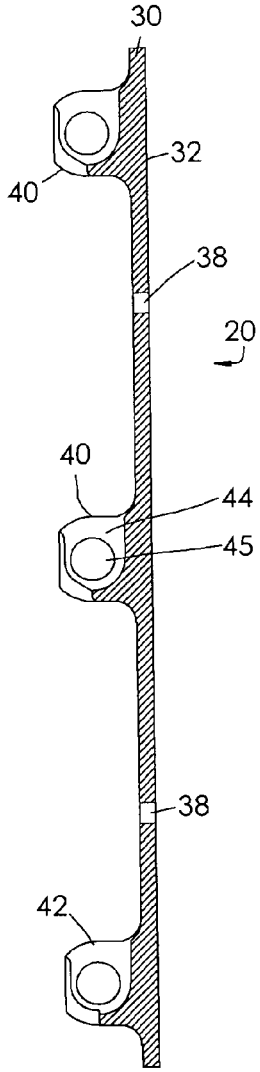
FIG. 8 is a side sectional view of the clip strip along section lines A/A of FIG. 7.

The clip strip 20, more specifically shown in an embodiment demonstrated in FIGS. 6-8, further defines the mounting body 30 having a flat rear surface 32, lateral sides margins 34 and a front surface 36. The rear surface 32 is attached to a vertical surface by means of adhesive or by a screw or other mechanical attaching means, the clip strip 20 further including at least two bores 38 through which the screw or mechanical attaching means is inserted for attachment. The front surface 36 projects the clip attaching sockets 40, each socket 40 comprising a pair of axially aligned and inner curved half segments 42 with a space between each half 42, each half 42 being placed near the respective lateral margin 34 and including an inner facing surface 44 with a concave aperture 45, the concave apertures 45 removably securing a rear spherical projection 80 between the paired half segments 42, as indicated in FIG. 1-3 of the drawings.

Figure 9:
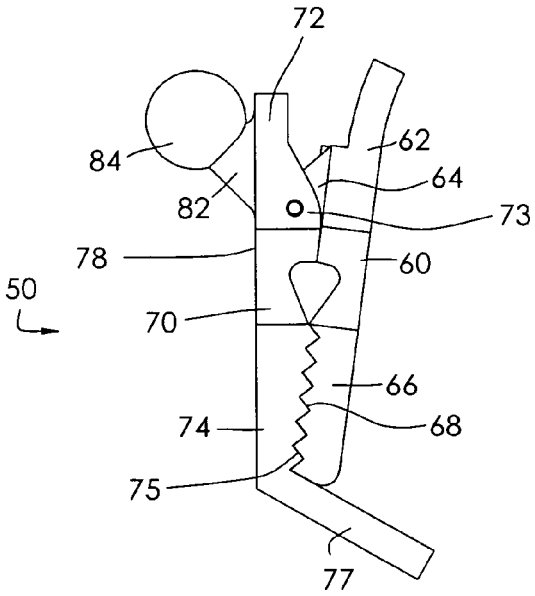
FIG. 9 is a side view of a single bag clip.
Figure 10:
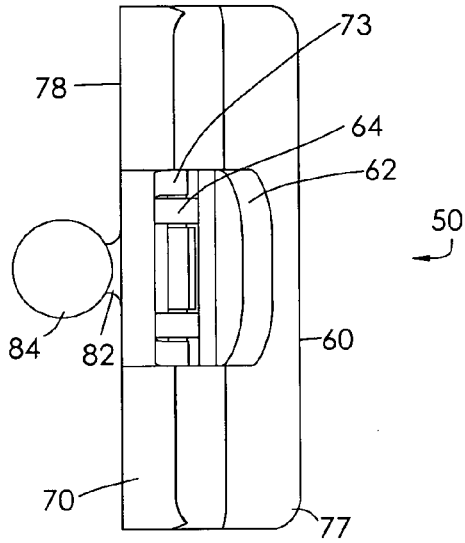
FIG. 10 is a top view of a bag clip.
Figure 11:
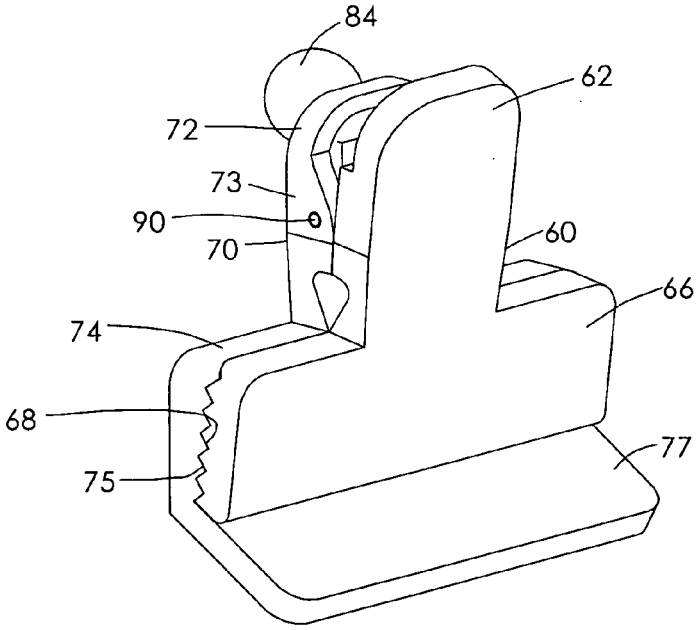
FIG. 11 is a front perspective view of a bag clip.

Each bag clip 50, as more specifically shown in an embodiment demonstrated in FIGS. 9-11, the spring clip 52 further defining a front clip section 60 pivotally attached to a rear section 70. The front section 60 in this preferred embodiment defines an upper lever flange 62, a rear hinge portion 64 and a lower clip flange 66, the lower clip flange 66 optionally providing a serrated rear surface 68. The rear section 70 in this preferred embodiment defines an upper tab portion 72, a front hinge portion 73 and a lower flange 74, the lower flange 74 optionally providing a serrated upper front section 75 and an outwardly extending lower section 77, with the rear hinge portion 64 of the front section 60 and the front hinge portion 73 of the rear section 70 attaching by a pin 90 and including a spring means 95, shown in FIG. 1 by phantom line, forcing the lower clip flange 66 of the front section 60 against the lower flange 74 of the rear section 70. To open the bag clip 50, the upper lever flange 62 is pressed against the upper tab portion 72.

The rear spherical projection 80, extending from a rear surface 78 of the rear section 70 of the bag clip 50 in the disclosed preferred embodiment, further defines a lower neck 82 projecting at an upward angle from the rear surface 78 and terminating into a ball sphere 84.

Figure 4:
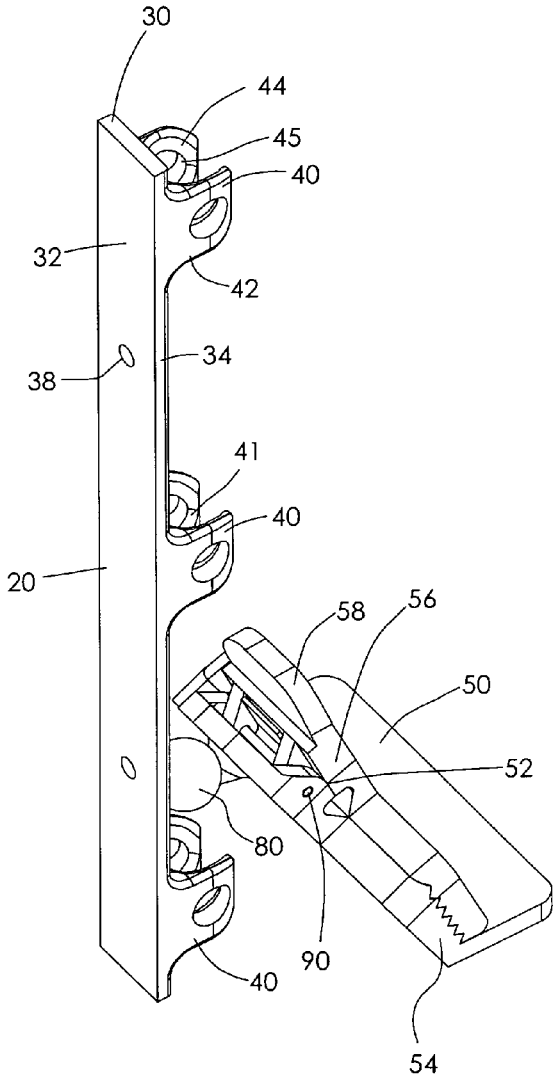
FIG. 4 is a rear perspective view of the clip strip with one bag clip detached from the clip strip.
Figure 5:
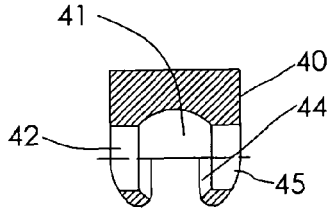
FIG. 5 is a top sectional view of the clip strip along section lines B/B of FIG. 7.

Each bag clip 50 attaches independently to a selected clip attaching socket 40 by forcing the rear spherical projection 80 within the socket 40, and in the preferred embodiment, by placing the ball sphere 84 between the axially aligned and paired half segments 42 with the ball sphere 84 being retained within each aligned concave aperture 45, FIGS. 1 and 3, from above, FIG. 4, or below the clip attaching socket 40. Detachment of the ball sphere 84 from the attaching socket 40 is performed by forcing the ball sphere 84 either upward, outward or below the attaching socket 40, also FIG. 4.

The most practical use for the bag clip strip 10 would lie in the storage of various food containing bags, keeping them sealed and also to store them in a manner where they can be seen and accesses with the additional benefit of hanging on a vertical surface to eliminate shelf storage in a kitchen or pantry. Each bag clip 50 can be attached to a folded bag margin and retain it as folded and also allow the bag to be removed with the bag clip 50 still holding the folded bag margin closed. Once the contents of the bag are withdrawn, the bag can be resealed and folded, the bag clip 50 is reattached and the bag clip 50 returned to the clip strip 20 for storage.

The optional serrated rear surface 68 of the front section 60 and the serrated upper front section 75 of the rear section 70 enhance the bag clip's ability to further secure the bag and prevent slippage of the contained bag from the bag clip 50. The optional outwardly extending lower section 77 provides a forward thrust to the bag contained within the bag clip 50 away from the clip strip 20 to allow a plurality of bags to be layer upon one another, which would actually assist the plurality of bag in being identified and also assist them in lying more flat in a vertical row.

While the bag clip strip 10 has been particularly shown and described with reference to a preferred embodiment thereof, it will be understood by those skilled in the art that changes in form and detail may be made therein without departing from the spirit and scope of the invention.

What is claimed is:

1. A bag clip strip, providing a storage means for retaining a plurality of open bags containing a product, said bag clip strip comprising:

a clip strip defining a flat planar mounting body upon which a plurality of resilient ball clip attaching sockets are provided, each ball clip attaching socket defining a spherical void; and a plurality of bag clips, each bag clip defining a spring clip having a lower end, an upper end defining a compression flange depressed to urge said lower end into an open position, and a rear spherical projection, each said spherical projection independently and removably inserted into and retained within one of said plurality of attaching sockets, said plurality of attaching sockets each capable of independently retaining a single bag clip, said mounting body further comprising:

a flat rear surface, lateral sides margins and a front surface, said front surface projecting said clip attaching sockets, each said attaching socket further comprising a pair of axially aligned and inner curved half segments, each half of said half segment extending near said respective lateral margin and including an inner facing surface with a concave aperture into which each said spherical projection is insertable into and retained within each said attaching socket, said concave apertures removably securing each said rear spherical projection between said paired half segments.

2. The bag clip strip as disclosed in claim 1, said spring clip further comprising:

a front clip section defining an upper lever flange, a rear hinge portion and a lower clip flange, said lower clip flange; and a rear section defining an upper tab portion, a front hinge portion, and a lower flange, said lower flange supporting an outwardly extending lower section providing a forward thrust to a bag contained within said bag clip away from said clip strip, with said rear hinge portion of said front section and said front hinge portion of said rear section hingably attaching by a pin and including a spring means, forcing said lower clip flange of said front section against said lower flange of said rear section, wherein said bag clip is opened by pressing said upper lever flange against said upper tab portion.

3. The bag clip strip as disclosed in claim 1, said spring clip further comprising:

a front clip section defining an upper lever flange, a rear hinge portion and a lower clip flange, said lower clip flange providing a serrated rear surface; and a rear section defining an upper tab portion, a front hinge portion, and a lower flange, said lower flange having a serrated upper front section which is in contact with said serrated rear surface when said spring clip is in a closed position, said lower flange further supporting an outwardly extending lower section providing a forward thrust to a bag contained within said bag clip away from said clip strip, with said rear hinge portion of said front section and said front hinge portion of said rear section hingably attaching by a pin and including a spring means, forcing said lower clip flange of said front section against said lower flange of said rear section, wherein said bag clip is opened by pressing said upper lever flange against said upper tab portion.

4. The bag clip strip as disclosed in claim 1, further comprising:

said spring clip defining a front clip section defining an upper lever flange, a rear hinge portion and a lower clip flange, said lower clip flange and a rear section defining an upper tab portion, a front hinge portion, and a lower flange, said lower flange supporting an outwardly extending lower section providing a forward thrust to a bag contained within said bag clip away from said clip strip, with said rear hinge portion of said front section and said front hinge portion of said rear section hingably attaching by a pin and including a spring means, forcing said lower clip flange of said front section against said lower flange of said rear section, wherein said bag clip is opened by pressing said upper lever flange against said upper tab portion; and said rear spherical projection extending from a rear surface of said rear section of said spring clip of said bag clip, and further defining a lower neck projecting at an upward angle from said rear surface and terminating into a ball sphere.

* * * * *